US007141751B2

(12) United States Patent
Kang et al.

(10) Patent No.: US 7,141,751 B2
(45) Date of Patent: Nov. 28, 2006

(54) BREAKER FOR PROVIDING SUCCESSIVE TRIP MECHANISM BASED ON PTC CURRENT-LIMITING DEVICE

(75) Inventors: Jong-Sung Kang, Cheongju-si (KR); Yun-Hyuk Kwon, Seoul (KR); Seok-Hyun Nam, Hwaseong-si (KR); Bang-Wook Lee, Cheongju-si (KR); Won-Joon Choi, Cheongju-si (KR)

(73) Assignee: LS Cable Ltd., Seoul (KR)

( * ) Notice: Subject to any disclaimer, the term of this patent is extended or adjusted under 35 U.S.C. 154(b) by 0 days.

(21) Appl. No.: 11/357,773

(22) Filed: Feb. 17, 2006

(65) Prior Publication Data

US 2006/0186090 A1 Aug. 24, 2006

(30) Foreign Application Priority Data

Feb. 21, 2005 (KR) ..... 10-2005-0014290

(51) Int. Cl.
*H01H 9/44* (2006.01)

(52) U.S. Cl. ..... 218/22; 335/6; 335/16; 218/153; 218/154

(58) Field of Classification Search ..... 218/22–27, 218/7, 10, 14, 140, 152–154; 335/6–10, 335/16, 195, 201, 147
See application file for complete search history.

(56) References Cited

U.S. PATENT DOCUMENTS 4,165,502 A * 8/1979 Andersen ..... 335/39
4,849,590 A * 7/1989 Becker et al. ..... 218/33
5,495,083 A * 2/1996 Aymami-Pala et al. ..... 218/1
6,326,868 B1 * 12/2001 Kranz et al. ..... 218/22
6,426,688 B1 * 7/2002 DeVizzi et al. ..... 218/22
6,665,157 B1 * 12/2003 Benard et al. ..... 361/13
2006/0006145 A1 * 1/2006 Baiatu ..... 218/153

* cited by examiner

*Primary Examiner*—Elvin Enad
*Assistant Examiner*—M. Fishman
(74) *Attorney, Agent, or Firm*—Jones Day

(57) ABSTRACT

Disclosed is a breaker for providing successive trip mechanism based on PTC current-limiting device, which includes a first switch having first fixed/movable contact points; a second switch having second fixed/movable contact and connected to the first switch in parallel; PTC current-limiting device connected to the first and second switches in parallel or series and allowing a change of current flow direction from the first switch to the second switch at a fault current; a movable arm to which the movable contact points are installed at an interval therebetween and opening/closing the switches by operating the movable contact points; a fixed arm including first and second fixed arm conductors for guiding current flow toward the first fixed contact point in a normal load current mode and guiding current flow toward the second fixed contact point via the PTC current-limiting device in a fault current mode; and a successive trip means for elastically biasing the second switch by operation of the movable arm in a closing direction when both switches are closed and successively tripping both switches using time taken for releasing the elastic bias of the second switch when the movable arm is operated in a tripping direction.

19 Claims, 11 Drawing Sheets

BREAKER FOR PROVIDING SUCCESSIVE TRIP MECHANISM BASED ON PTC CURRENT-LIMITING DEVICE

BACKGROUND OF THE INVENTION

1. Field of the Invention

The present invention relates to a breaker employing a current-limiting device having PTC (Positive Temperature Coefficient) characteristics, and more particularly to a breaker for limiting and breaking a fault current using successive trips by electrically connecting a current-limiting device having PTC characteristics to a plurality of switches.

2. Description of the Related Art

Breakers are widely used for protecting lines and power equipments installed on the lines against a fault current such as a short circuit current in a power system such as a transmission system and a distribution system.

A conventional breaker includes a switch having a fixed contact point and a movable contact point and serially connected to a line for selective opening and closing, an extinction grid for extinguishing an arc generated in the switch while a fault current of the line is broken, and a movable contact point pivoting means for sensing a fault current and tripping the switch by making an angular motion of the movable contact point.

Seeing the operation of the conventional breaker, the fixed contact point and the movable contact point keep a contacted state between them at an ordinary time by using a certain force applied by the movable contact point pivoting means. However, if a fault current flows along the line, an electron repelling force generated between the fixed contact point and the movable contact point makes the movable contact point be rapidly released from the fixed contact point. Arc is generated between the released fixed and movable contact points, and the generated arc is operated toward the surrounding extinction grid, and then cooled and divided. The arc operated toward the extinction grid results in a voltage drop of the line, which limits a fault current flowing on the line, and the limited fault current is completely broken at an artificial current zero point by means of cooling and division of the arc.

Recently, various attempts have been made for realizing an efficient current-limiting and tripping operation of a breaker by connecting a mechanical switch with a current-limiting device having PTC characteristics that makes abrupt change of resistance according to temperature.

The current-limiting device is heated to increase its temperature abruptly by Joule heat when a fault current flows on a line, and its resistance value is abruptly increased when the temperature exceeds a threshold temperature. Accordingly, the fault current of the line is limited by the current-limiting device, and in this state the switch is mechanically operated to break the line.

If the line is broken, the temperature of the current-limiting device is dropped below the threshold temperature, and accordingly the resistance value of the current-limiting device is restored to its initial value. In addition, if a main cause of the fault current is removed and then the breaker is closed again, a common load current flows on the line.

The following prior art shows a breaker prepared by coupling a current-limiting device with a switch as mentioned above.

First, U.S. Pat. No. 2,639,357 discloses a technique of realizing a breaker by connecting a current-limiting device and switches in parallel. However, U.S. Pat. No. 2,639,357 has a drawback that a fault current is not suitably switched to the current-limiting device.

U.S. Pat. No. 4,878,038 discloses a technique of realizing a breaker by connecting a current-limiting device with switches in series. However, U.S. Pat. No. 4,878,038 has a problem that the current-limiting device connected with a line in series is continuously heated due to Joule heat at ordinary times, so a power loss is caused even when an ordinary load current flows.

U.S. Pat. No. 5,629,658 proposes a breaker operated using the successive trip mechanism by connecting a current-limiting device with a plurality of switches in parallel and in series in order to solve the problem of U.S. Pat. No. 4,878,038.

FIG. 1 shows a concept of the successive trip mechanism. As shown in FIG. 1, in the breaker of U.S. Pat. No. 5,629,658, a first switch 10 is connected to a current-limiting device 12 in parallel, and a second switch 14 is connected to the current-limiting device 12 in series. A load current at ordinary times flows through the first switch 10 having a relatively low resistance value. Thus, a problem of power loss caused by Joule heat generated in the current-limiting device 12 does not happen. Meanwhile, if a fault current such as a short circuit current occurs in a line L, the first switch 10 is firstly tripped due to the electron repelling force. According, the fault current flows through the second switch 14 and the current-limiting device 12. If the fault current flows on the current-limiting device 12, the fault current is limited due to the current limiting action of the current-limiting device 12. In addition, the second switch 14 is tripped due to the electron repelling force caused by the fault current and a second switch opening/closing tool separately prepared, so the fault current limited by the current-limiting device 12 is completely broken by the second switch 14.

Japanese Patent Publication No. H10-326554 proposes a more specific structure of a breaker adopting the successive trip mechanism.

FIG. 2 is a schematic view showing the breaker of H10-326554. As shown in FIG. 2, the breaker of H10-326554 includes a fixed arm 20 directly connected to a power source of a line and having a first fixed contact point 16 and a second fixed contact point 18 to which a PTC current-limiting device is fixed; and a movable arm 26 directly connected to a load of the line to rotate by an opening/closing tool and having a first movable contact point 22 contacting with the first fixed contact point 16, and a second movable contact point 24 contacting with the second fixed contact point 18.

The movable arm 26 is divided into a first movable arm 28 having elasticity and to which the first movable contact point 22 is attached, and a second movable arm 26 to which the second movable contact point 24 is attached. At ordinary times, the first contact points 16 and 22 and the second contact points 18 and 24 are electrically connected with each other, and a resistance between the first contact points 16 and 22 is smaller than a resistance between the second contact points 18 and 24, so most current flows through the first contact points 16 and 22 and the first movable arm 28.

If a fault such as a short circuit occurs in a line to flow a fault current through the line, an electron repelling force acts between the first fixed contact point 16 and the first movable contact point 22 so that the first movable arm 28 moves upward, which makes the first movable contact point 22 be released from the first fixed contact point 16. Accordingly, the fault current flows through the second fixed contact point 18 and the second movable contact point 24, and the fault current is limited by means of the current limiting action of the current-limiting device fixed to the second fixed contact point 24. At the same time, if the opening/closing tool detects the fault current and pivots the entire movable arm 26 upward, the fault current flowing between the second fixed contact point 18 and the second movable contact point 24 is completely broken.

However, the breaker of H10-326554 shows the following problems.

First, during the fault current breaking procedure of the breaker, an arc generated when the first contact points 16 and 22 are released may be operated toward the second fixed contact point 18, and also when the second contact points 18 and 24 are released, a serious arc is generated even between the second fixed contact point 16 and the second movable contact point 24. Arc causes a high temperature capable of melting metal or nonmetal material, so the second fixed contact point 24 composed of a PTC current-limiting device is apt to be melt, damaged or divided due to such an arc.

Second, when the breaker is closed, the second contact points 18 and 24 are firstly closed, and then the first contact points 16 and 22 are closed. Even in this breaker closing procedure, an arc is generated between the second contact points 18 and 24. Thus, the arc generated during the breaker closing procedure is apt to melt, damage or divide the second fixed contact point 24 composed of a PTC current-limiting device.

Third, the second fixed contact point 24 is composed of a PTC current-limiting device that is weaker than general contact point materials, so it is apt to be easily deformed or damaged. In addition, if the contact point itself is composed of a PTC current-limiting device, there is a drawback of shortening an electric life of the breaker as well as a mechanical life.

Fourth, a contact resistance between the first contact points 16 and 22 should be smaller than a contact resistance between the second contact points 18 and 24. However, if a contact resistance between the second contact points 18 and 24 is excessively great in comparison to a contact resistance between the first contact points 16 and 22, a fault current is not adequately switched to the second contact points 18 and 24 though the first contact points 16 and 22 are released before.

The breaker of H10-326554 configures the second fixed contact point 18 with a PTC current-limiting device. However, in this case, though a contact resistance between the second fixed contact point 18 and the second movable contact point 24 is increased to release the first contact points 16 and 22, a fault current may be not adequately switched toward the second contact points 18 and 24.

Fifth, a general contact point material is attached to the fixed arm 20 and the movable arm 26 by means of brazing. However, since the second fixed contact point 18 is composed of a PTC current-limiting device, it is impossible to use brazing for attachment of the contact points.

Sixth, the first movable arm 28 is made of metal with great elasticity. Thus, though the first movable contact point 22 and the first fixed contact point 16 attached to the first movable arm 28 are released due to an electron repelling force when a fault current occurs, the first movable arm 28 may be quickly closed again due to the elasticity of the first movable arm 28, which may resultantly limit the fault current insufficiently.

SUMMARY OF THE INVENTION

The present invention is designed to solve the problems of the prior art, and therefore it is an object of the present invention to provide a breaker for providing successive trip mechanism, which is capable of preventing deterioration of a PTC current-limiting device, preventing a previously released switch from being closed again, and easily switching a fault current toward the PTC current-limiting device.

In order to accomplish the above object, the present invention provides a breaker for providing successive trip mechanism based on a PTC current-limiting device, the breaker comprising: a first switch having a first fixed contact point and a first movable contact point; a second switch having a second fixed contact point and a second movable contact point and connected to the first switch in parallel; a PTC current-limiting device connected to the second switch in series and to the first switch in parallel, the PTC current-limiting device allowing a change of current flow direction from the first switch to the second switch when a fault current occurs; a movable arm to which the first and second movable contact points are installed at a predetermined interval therebetween, the movable arm opening/closing the first and second switches by operating the first and second movable contact points; a fixed arm including a first fixed arm conductor for guiding current flow toward the first fixed contact point in a normal load current mode, and a second fixed arm conductor for guiding current flow toward the second fixed contact point via the PTC current-limiting device in a fault current mode; and a successive trip means for elastically biasing the second switch by means of an operation of the movable arm in a closing direction when the first and second switches are closed, the successive trip means successively tripping the first and second switches using a time taken for releasing the elastic bias of the second switch when the movable arm is operated in a tripping direction.

In one aspect of the invention, the first and second fixed contact points are provided on the first and second fixed arm conductors extended to the first and second fixed contact points so that an angle between the first fixed and movable contact points is greater than an angle between the second fixed and movable contact points while the first and second switches are in a tripped state, and wherein the successive trip means includes a geometric structure of the second fixed arm conductor that elastically biases the second switch in proportion to a relative difference of both angles when the first and second switches are closed.

In another aspect of the invention, the first and second fixed contact points are provided on the first and second fixed arm conductors extended to the first and second fixed contact points so that an angle between the first fixed and movable contact points is greater than an angle between the second fixed and movable contact points while the first and second switches are in a tripped state, and wherein the successive trip means is a torsion spring that elastically biases the second switch by elastically rotating a part of the second fixed arm conductor provided with the second fixed contact point on the center of a predetermined rotary axis in proportion to a relative difference of both angles when the first and second switches are closed.

In still another aspect of the invention, the first and second fixed contact points are provided on the first and second fixed arm conductors extended to the first and second fixed contact points so that an angle between the first fixed and movable contact points is greater than an angle between the second fixed and movable contact points while the first and second switches are in a tripped state, wherein the movable arm is provided with a guide housing including a compression spring mounted therein, wherein the second movable contact point is received in the guide housing so that one side thereof faces the compression spring and the other side is exposed outward to face the second fixed contact point, and wherein the successive trip means is the compression spring that elastically biases the second switch by means of a back movement of the second movable contact point in proportion to a relative difference of both angles when the first and second switches are closed.

In further another aspect of the invention, the movable arm has a bent that is elastically deformable, wherein the first and second fixed contact points are provided on the first and second fixed arm conductors extended to the first and second fixed contact points, wherein the second movable contact point is provided to the bent, wherein an angle between the first fixed and movable contact points is greater than an angle between the second fixed and movable contact points when the first and second switches are in a tripped state, and wherein the successive trip means is the bent that elastically biases the second switch by being elastically deformed in proportion to a relative difference of both angles when the first and second switches are closed.

Preferably, the breaker of the present invention further includes a movable arm pivoting means for detecting a fault current over a predetermined level when a fault current occurs, and providing the movable arm with a rotating force for tripping the second switch within a predetermined time, wherein the first switch is operated in a tripping direction by means of an electron repelling force generated between the first fixed contact point and the first movable contact point, and the second switch is operated in a tripping direction by means of an electron repelling force generated between the second fixed contact point and the second movable contact point and the rotating force provided by the movable arm pivoting means. In addition, the second switch is positioned outer than the first switch on the basis of a rotary axis of the movable arm.

Preferably, the first fixed arm conductor provides an electric conduction path so that currents around both first fixed and movable contact points of the first switch flow in opposite directions. In addition, the second fixed arm conductor preferably provides an electric conduction path so that currents around both second fixed and movable contact points of the second switch flow in opposite directions.

In order to accomplish the above object, there is also provided a breaker for providing successive trip mechanism based on a PTC current-limiting device, the breaker comprising: a first switch having a first fixed contact point and a first movable contact point; a second switch having a second fixed contact point and a second movable contact point and connected to the first switch in parallel; a movable arm to which the first and second movable contact points are installed oppositely on the center of a rotary axis at a predetermined interval therebetween, the movable arm opening/closing the first and second switches by angularly moving the first and second movable contact points in opposite directions by means of a rotating mechanism; first and second fixed arms to which the first and second fixed contact points are installed respectively; a PTC current-limiting device connected to the first switch in parallel and to the second switch in series, the PTC current-limiting device allowing a change of current flow direction from the first switch to the second switch when a fault current occurs; and a successive trip means for elastically biasing the second switch by means of an operation of the movable arm in an closing direction when the first and second switches are closed, the successive trip means successively tripping the first and second switches using a time taken for releasing the elastic bias of the second switch when the movable arm is pivoted in a tripping direction.

Preferably, an angle between the first fixed and movable contact points is greater than an angle between the second fixed and movable contact points when the first and second switches are in a tripped state.

Preferably, the successive trip means is a geometric structure of the second fixed arm conductor that is elastically deformed to elastically bias the second switch in proportion to a relative difference of both angles when the first and second switches are closed.

As an alternative, the successive trip means is a torsion spring that elastically biases the second switch by elastically rotating a part of the second fixed arm provided with the second fixed contact point on the center of a predetermined rotary axis in proportion to a relative difference of both angles when the first and second switches are closed.

As another alternative, a guide housing including a compression spring is provided at a position of the movable arm provided with the second movable contact point, the second movable contact point is received in the guide housing so that one side thereof faces the compression spring and the other side is exposed outward to face the second fixed contact point, and the successive trip means is the compression spring that elastically biases the second switch by means of a back movement of the second movable contact point in proportion to a relative difference of both angles when the first and second switches are closed.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail with reference to the accompanying drawings. Prior to the description, it should be understood that the terms used in the specification and appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
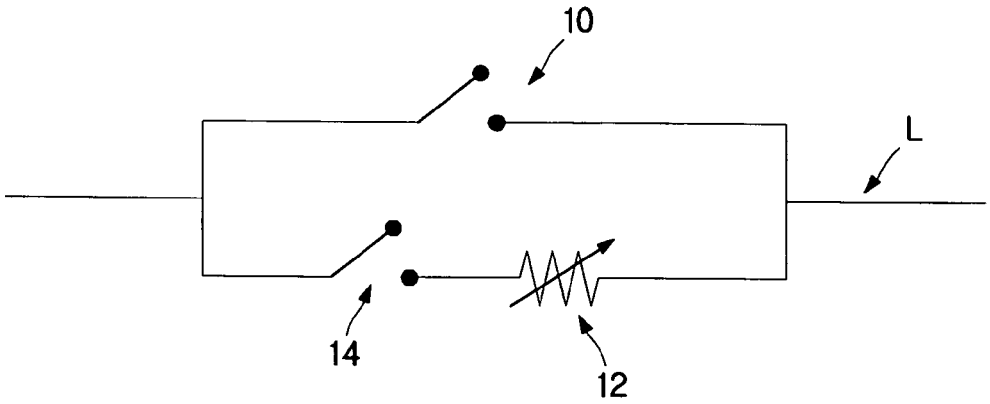
FIG. 1 (PRIOR ART)
FIG. 1 is a circuit diagram showing the concept of breaking a fault current using a successive trip mechanism according to the prior art.
Figure 2:
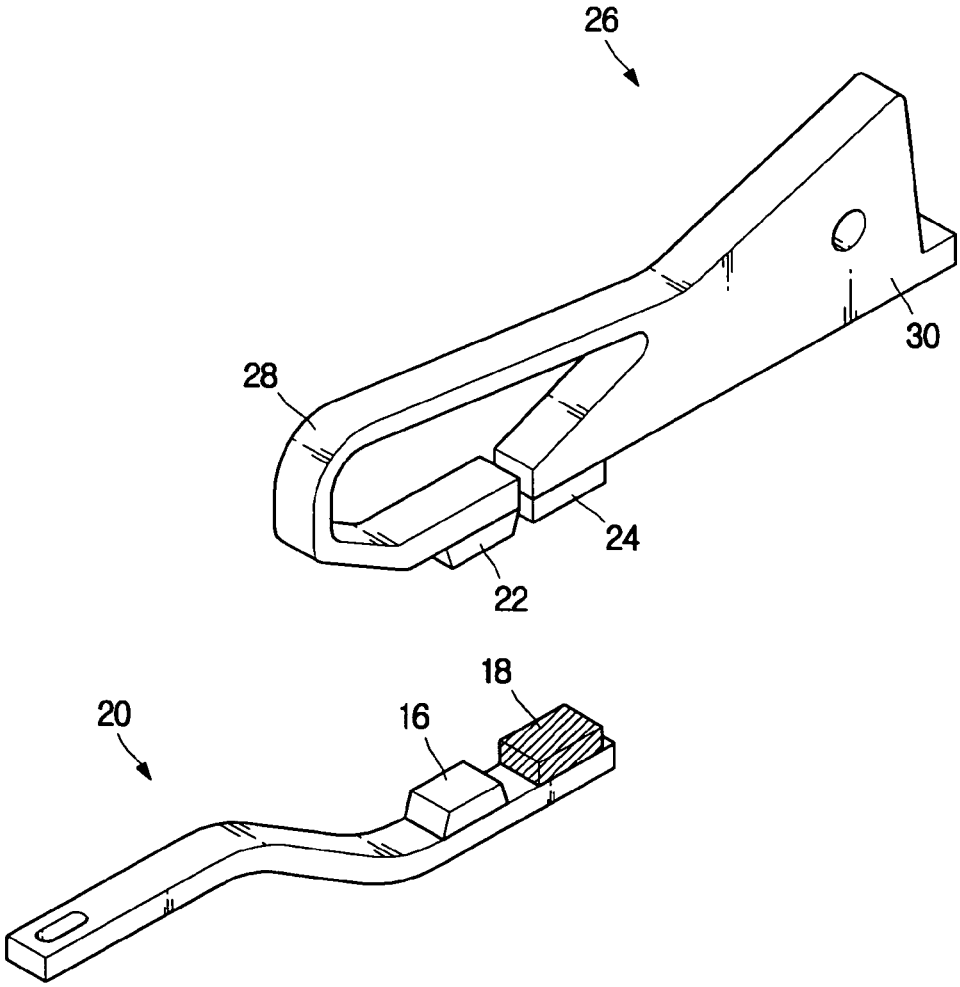
FIG. 2 (PRIOR ART)
FIG. 2 is a perspective view showing a breaker for providing successive trip mechanism according to the prior art.
Figure 3A:
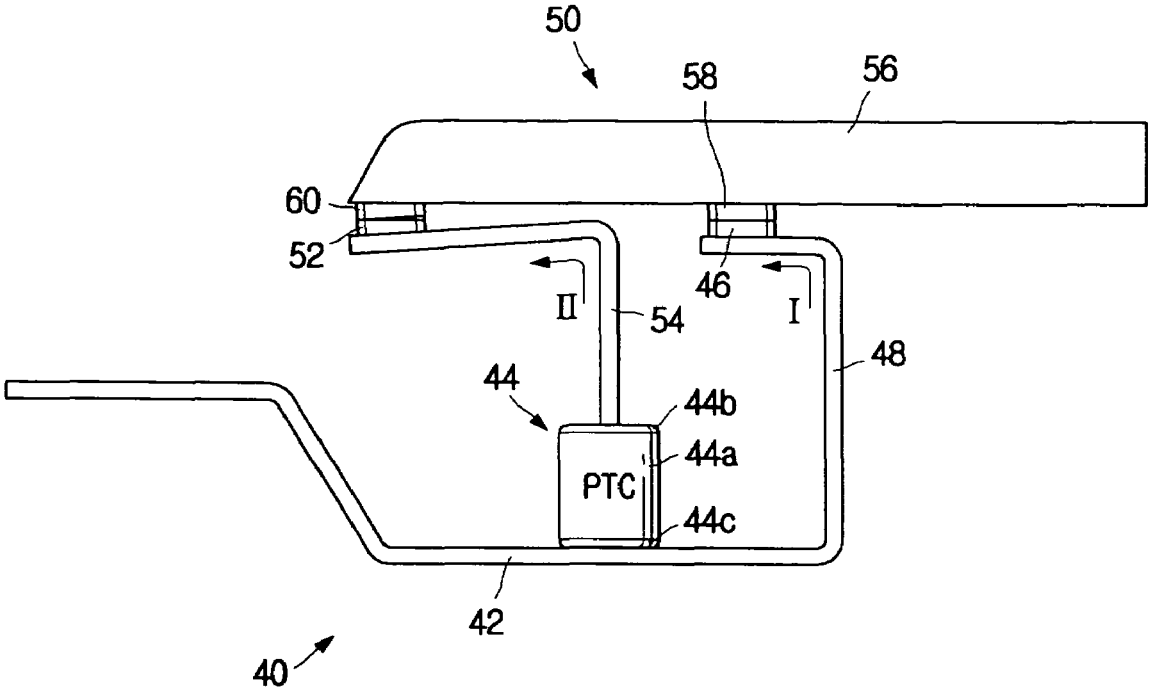
FIGS. 3*a* to 3*c* are side views respectively showing a breaker-closed state, a first switch tripped state, and a first/second switch tripped state according to a first embodiment of the present invention.
Figure 3B:
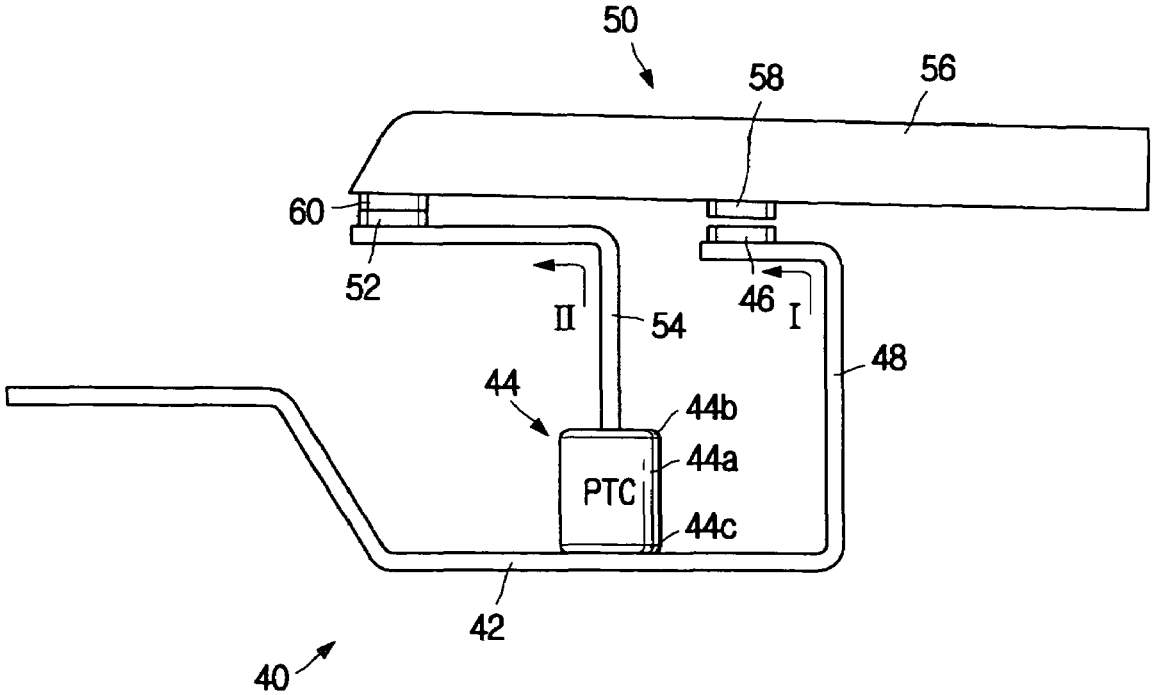
Figure 3C:
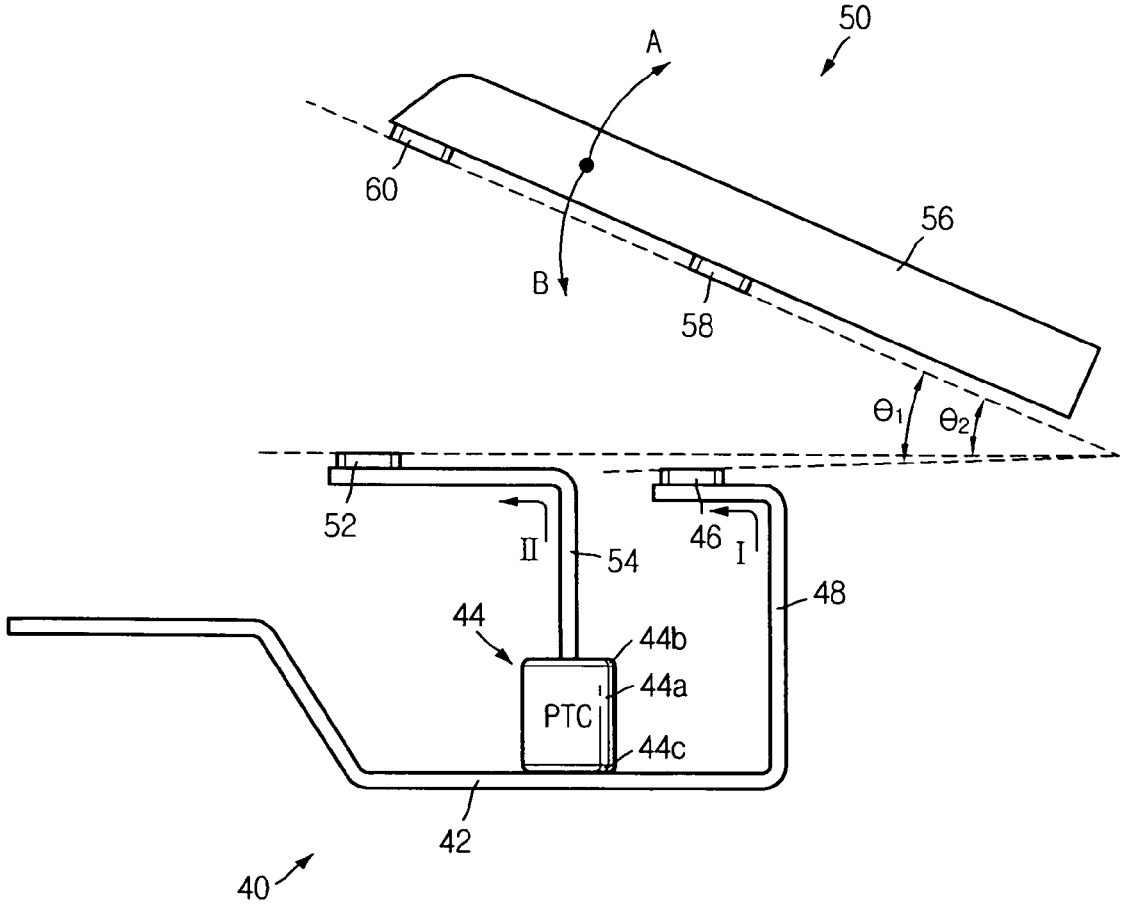

FIGS. 3*a* to 3*c* respectively show a breaker-closed state, a first switch tripped state, and a first/second switch tripped state of a breaker according to a first embodiment of the present invention.

The breaker according to the first embodiment of the present invention includes a fixed arm 40 and a movable arm 50 in brief as shown in FIGS. 3*a* to 3*c*. The fixed arm 40 includes a fixed arm member 42 having one end electrically connected to a power source of a line, a PTC (Positive Temperature Coefficient) current-limiting device 44 attached to the fixed arm member 42, a first fixed contact point 46, a first fixed arm conductor 48 to which the first fixed contact point 46 is attached and guiding electric flow toward the first fixed contact point 46, a second fixed contact point 52, and a second fixed arm conductor 54 to which the second fixed contact point 52 is attached and guiding electric flow toward the second fixed contact point 52.

The second fixed arm conductor 54 has a geometric structure capable of giving an elastic bias by means of elastic deformation. As shown in FIGS. 3*a* to 3*c*, this geometric structure has a '⌉' shape. However, the present invention is not limited thereto. The second fixed arm conductor 54 is configured with a metal plate made of elastically deformable metal such as copper and brass. The first fixed arm conductor 48 is made of material substantially identical to that of the second fixed arm conductor 54.

The movable arm 50 includes a movable arm member 56 having one end electrically connected to a load of the line, and first and second movable contact point 58 and 60 attached to the movable arm member 56 at a predetermined interval between them. Here, the first fixed contact point 46 and the first movable contact point 58 configure a first switch, while the second fixed contact point 52 and the second movable contact point 60 configure a second switch. Preferably, the movable arm member 56 is configured with a metal plate made of copper, brass or the like. In addition, the first and second fixed contact points 46 and 52 and the first and second movable contact points 58 and 60 are made of a metal piece of a plate shape with excellent arc-resistant characteristics such as AgCdO, AgC and AgWC.

The movable arm 50 operates the first and second movable contact points 58 and 60 in a tripping direction A (see FIG. 3*c*) or in an closing direction B (see FIG. 3*c*) to open or close the first and second switch. Preferably, the movable arm 50 is operated by means of the rotating mechanism. For this purpose, a right portion of the movable arm 50 is coupled to a movable arm pivoting means, not shown, and rotated thereon. However, the present invention is not limited thereto.

The movable arm pivoting means may employ a movable arm pivoting means used in MCCB (Molded Case Circuit Breaker) well known in the art, as it is. The movable arm pivoting means applies a contact pressure to the first and second switches when the breaker is in a closed state, and also applies a rotating force to the movable arm 50 within a predetermined time to break a fault current when a fault current over a predetermined level is detected.

One end of the PTC current-limiting device 44 is connected to the fixed arm member 42, and the other end is electrically connected to the second fixed arm conductor 54 and the second fixed contact point 52. Thus, the PTC current-limiting device 44 may ensure a significant distance from the first and second switches. Accordingly, when the breaker breaks a fault current or the breaker is closed again, an influence affected on the PTC current-limiting device 44 by an arc generated from the first and second switches may be minimized.

The PTC current-limiting device 44 is configured so that upper and lower electrodes 44*b* and 44*c* face each other with a PTC material layer 44*a* having a plate shape being interposed between them as well known in the art. Preferably, the PTC material layer 44*a* includes crystalline polymer resin and conductive material particles, and also has a nonlinear resistance characteristic that a specific resistance at 25° C. is 1 Ω cm or below, and the specific resistance is increased to 10 Ωcm or above when a fault current occurs. However, the present invention is not limited thereto. The upper and lower electrodes 44*b* and 44*c* are configured with a metal plate made of aluminum, silver, copper or the like.

As shown in FIG. 3*a*, if the breaker according to the first embodiment of the present invention is in an ordinary closed state, the first fixed contact point 46 electrically contacts with the first movable contact point 58, and the second fixed contact point 52 is pressed to electrically contact with the second movable contact point 60. Accordingly, the first switch is connected to the PTC current-limiting device 44 in parallel, while the second switch is connected to the PTC current-limiting device 44 in series.

Meanwhile, the second fixed and movable contact points 52 and 60 are pressed to contact with each other due to the following reasons. As shown in FIG. 3*c*, an angle $\theta_2$ between the second fixed contact point 52 and the second movable contact point 60 is relatively smaller than an angle $\theta_1$ between the first fixed contact point 46 and the first movable contact point 58, and the second fixed arm conductor 54 has a geometrical structure that allows elastic deformation. Thus, if the movable arm 50 is rotated to close the first and second switches as shown in FIG. 3*a*, the second fixed arm conductor 54 is elastically deformed to elastically bias the second switch. Here, the angle is an angular distance between contact points on the basis of a position where extension lines starting from two contact point surfaces meet. The degree of the elastic bias of the second switch is proportional to a difference of both angles '$\theta_1-\theta_2$'.

If the second switch is elastically biased as mentioned above, points of tripping times of the first and second switches when a fault current occurs are changed, and as a result the first and second switches are successively tripped. It will be explained in more detail later. Hereinafter, a component that causes successive trips of the first and second switches by elastically biasing the second switch as mentioned above will be named 'a successive trip means'. In the first embodiment, the successive trip means is the geometric structure of the second fixed arm conductor 54 that is elastically deformable.

If the breaker is in a closed state as shown in FIG. 3*a*, a path allowing current flow includes a first path I composed of the fixed arm member 42, the first fixed arm conductor 48, the first fixed contact point 46, the first movable contact point 58 and the movable arm member 56, and a second path II composed of the fixed arm member 42, the PTC current-limiting device 44, the second fixed arm conductor 54, the second fixed contact point 52 and the second movable contact point 60. However, since the PTC current-limiting device 44 has an initial resistance value, most of the ordinary load current flows through the first path I. Thus, just a little current flows along the second path II, and as a result it is possible to minimize a power loss caused by heating of the PTC current-limiting device 44.

The breaker of the present invention has a current limiting function. This current limiting function needs an assumption of faster release of contact points. That is to say, if a fault current occurs on the line, the breaker should rapidly detect the occurrence of the fault current, and then automatically conduct a contact point releasing operation. For this purpose, the breaker uses an electron repelling force generated between the contact points. The electron repelling force is generated in two kinds of patterns.

In the first pattern, the electron repelling force is generated between the first fixed contact point 46 and the first movable contact point 58 and between the second fixed contact point 52 and the second movable contact point 60. While the breaker is in a closed state, each contact point 46, 52, 58 or 60 is electrically connected due to a suitable contact pressure. Of course, since the second fixed arm conductor 54 is elastically biased, the contact pressure between the second fixed and movable contact points 52 and 60 is greater than the contact pressure between the first fixed and movable contact points 46 and 58.

Figure 8:
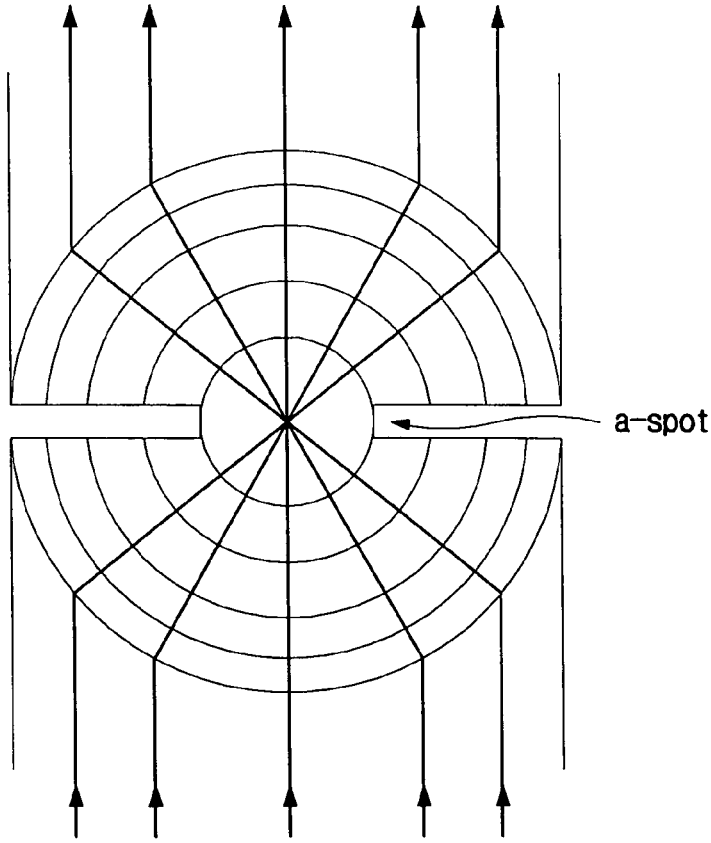
FIG. 8 is a concept view illustrating the principle of electron repelling force generated in an interface between contact points.

Seeing each contact point 46, 52, 58 or 60 with the eyes of a human, the contact points are looked to perfectly come in contact with each other as if the contact portion is electrically well connected. However, in fact, both contact points are partially electrically connected as shown in FIG. 8, namely arising 'a-spot'. A size of the 'a-spot' determines contact resistance and contact repelling force between both contact points, and it is generally depending on a contact pressure and an interface characteristic of the contact point material. If the 'a-spot' arises in the interface of contact points, a current path relatively gathers in the 'a-spot' as shown by arrows in FIG. 8, and as a result a repelling force is generated between both contact points.

Figure 9:
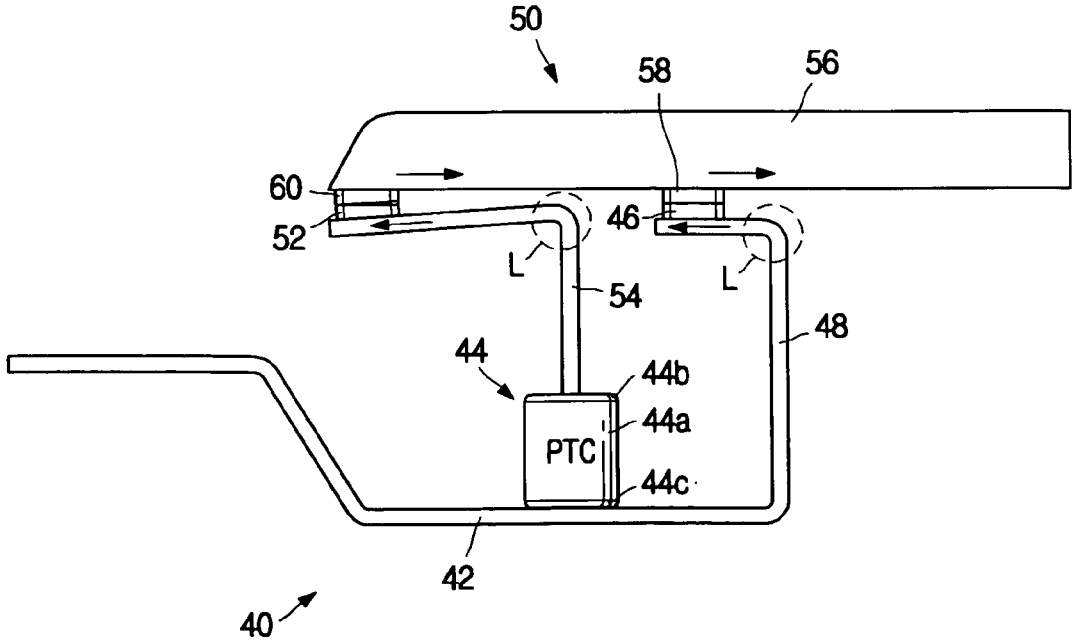
FIG. 9 is a concept view illustrating the principle of electron repelling force generated due to the Fleming's left-hand rule.

In the second pattern, the electron repelling force is related to a direction of the magnetic field formed around the first and second switches. That is to say, if directions of the currents around the first fixed contact point 46 and the first movable contact point 58 and around the second fixed contact point 52 and the second movable contact point 60 become relatively opposite, an electron repelling force is generated in each interface between contact points according to the Fleming's left-hand rule. For this purpose, the present invention arranges an electric conduction path so that a direction from bents L of the first and second fixed arm conductors 48 and 54 toward the first and second fixed contact points 46 and 52 is opposite to a direction from the first and second movable contact points 58 and 60 toward the rotary axis of the movable arm 50, as shown in FIG. 9. Then, an electron repelling force is generated between the first fixed and movable contact points 46 and 58 and between the second fixed and movable contact points 52 and 60 according to the Fleming's left-hand rule.

Now, the successive trip operation of the breaker according to the first embodiment of the present invention is described in detail. First, while the breaker is closed as shown in FIG. 3*a*, the movable arm 50 presses the first and second switches by means of a wipe spring provided to the movable arm pivoting means. At this time, the second switch comes to an elastically biased state due to elastic deformation of the geometric structure of the second fixed arm conductor 54 that is a successive trip means. In addition, if only a common load current flows in the line in which the breaker is installed, though an electron repelling force is generated in an interface between contact points of the first and second switches, this electron repelling force cannot overcome the force of the wipe spring applied to the movable arm 50. Thus, the movable arm 50 is not lifted up.

However, if a fault occurs in the line in which the breaker is installed and thus a fault current starts flowing therein, a magnitude of the electron repelling force is increased in proportion to square of current. And then, at the instant that the electron repelling force overcomes the force of the wipe spring of the movable arm pivoting means, the movable arm 50 is lifted up. Accordingly, as shown in FIG. 3*b*, the first fixed contact point 46 and the first movable contact point 58 are firstly released, and at the same time the elastically biased state of the second switch is released so that only the second fixed contact point 52 and the second movable contact point 60 are electrically connected. During the short time that the elastically biased state of the second switch is released, the first switch keeps its tripped state and the second switch keeps its closed state. In addition, during this procedure, a predetermined gap is formed between the first fixed and movable contact points 46 and 58, thereby fundamentally preventing the first switch from being closed again.

At the instant that the first switch is tripped, most of the fault current having flowed along the first path I is directed to the second path II and flows to the PTC current-limiting device 44. Then, the PTC current-limiting device 44 starts being heated to increase its temperature rapidly. If the temperature of the PTC current-limiting device 44 keeps increasing and exceeds a threshold temperature, a resistance value of the PTC current-limiting device 44 is abruptly increased to limit the fault current.

In parallel to the fault current limiting operation of the PTC current-limiting device 44, the movable arm pivoting means detects a fault current flowing in the second path II. After that, if it is determined that the detected current level is over a predetermined fault current level, the movable arm pivoting means rotates the movable arm 50 in a tripping direction A as shown in FIG. 3*c* so that the second fixed contact point 52 and the second movable contact point 60 can be released within a predetermined time. In general cases, the wipe spring that gives a contact pressure to the movable arm 50 releases its elastically biasing state so that the movable arm 50 is rotated.

Meanwhile, an arc is generated while the first fixed contact point 46 and the first movable contact point 58 are released, but an arc energy is not great since most of the fault current is directed to the second path II, and also the generated arc is cooled and divided due to an extinction grid, not shown. In addition, an arc is also generated while the second fixed contact point 52 and the second movable contact point 60 are released, but the arc generated during the releasing procedure of the second switch does not have a great energy since most of the fault current energy is exhausted due to the heating of the PTC current-limiting device 44, and also the generated arc is cooled and divided by the extinction grid. In addition, the PTC current-limiting device 44 is arranged at a position spaced apart from the first and second switches. Thus, it can be effectively prevented that the PTC current-limiting device 44 sensitive to arc is damaged while the breaker is operating.

Figure 4A:
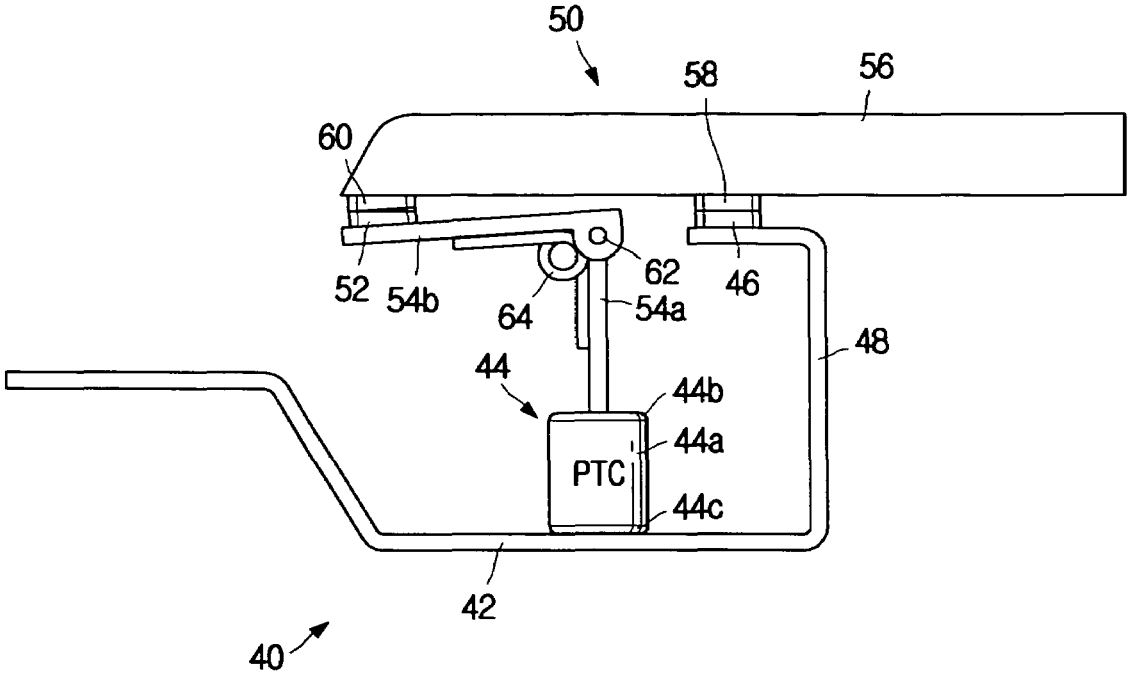
FIGS. 4*a* to 4*c* are side views respectively showing a breaker-closed state, a first switch tripped state, and a first/second switch tripped state according to a second embodiment of the present invention.
Figure 4B:
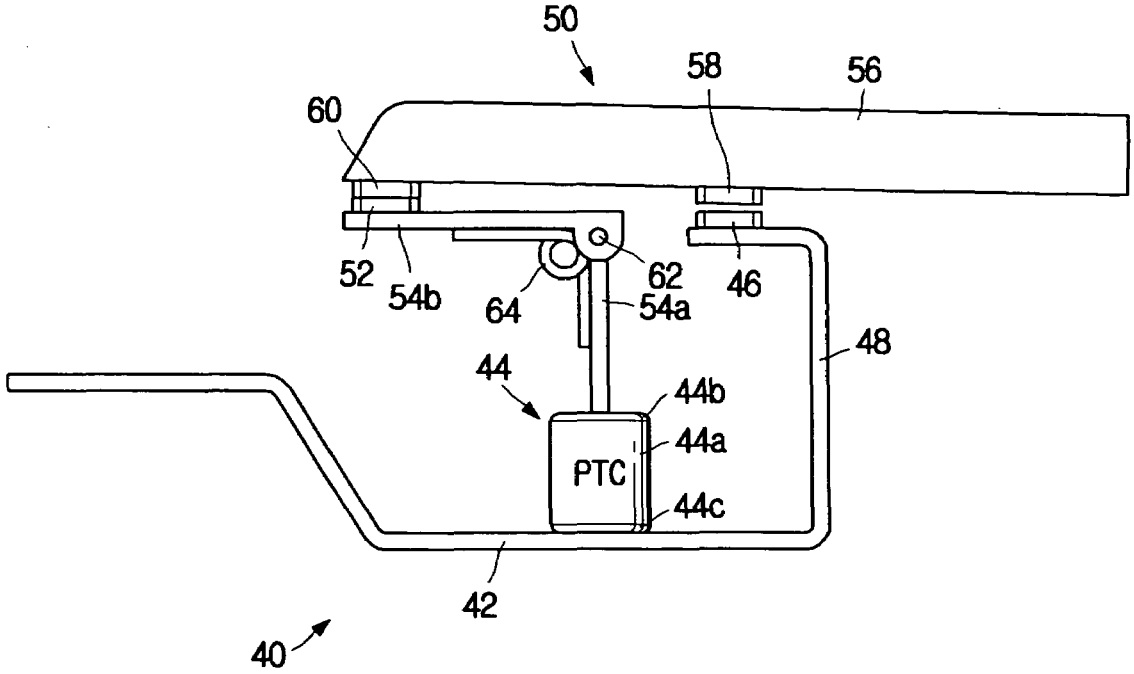
Figure 4C:
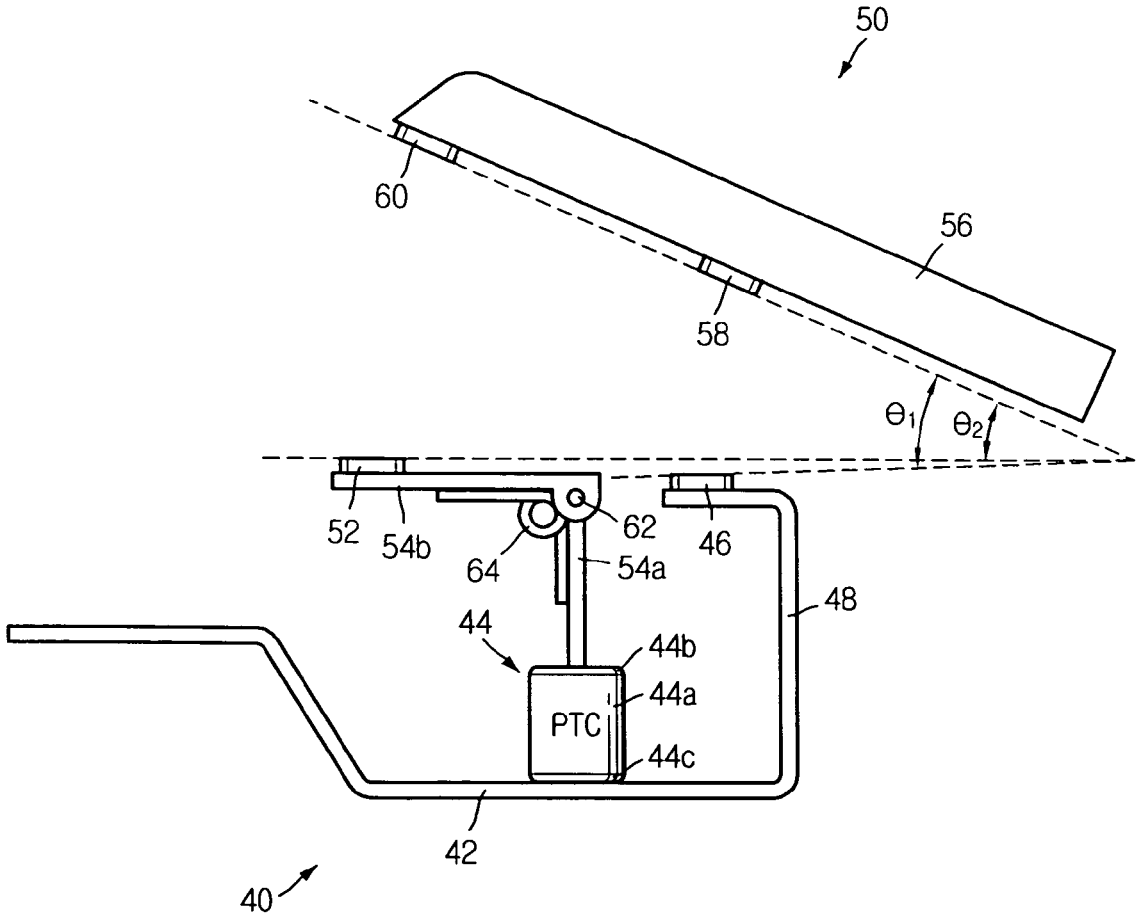

FIGS. 4*a* to 4*c* respectively show a breaker-closed state, a first switch tripped state, and a first/second switch tripped state of a breaker according to a second embodiment of the present invention.

According to the second embodiment of the present invention, as shown in FIGS. 4*a* to 4*c*, a second vertical fixed arm conductor 54*a* and a second horizontal fixed arm conductor 54*b* are coupled to be pivotable on the center of a rotary axis 62, and the second vertical and horizontal fixed arm conductors 54*a* and 54*b* are elastically coupled using a torsion spring 64. Other configurations of the second embodiment are substantially identical to those of the first embodiment.

Like the first embodiment, an angle $\theta_1$ between the first fixed and movable contact points 46 and 58 is relatively greater than an angle $\theta_2$ between the second fixed and movable contact point 52 and 60 in the breaker of the second embodiment, as shown in FIG. 4*c*. Thus, if the breaker is closed as shown in FIG. 4*a*, the second horizontal fixed arm conductor 54*b* is rotated on the rotary axis 62 (e.g., in a counterclockwise direction) so that the torsion spring 64 is elastically deformed. Here, the degree of the elastic deformation is proportional to a difference of both angles '$\theta_1-\theta_2$'. As a result, the second switch comes to an elastically biased state. Thus, in the second embodiment, the torsion spring 64 acts as a successive trip means that causes successive trips of the first and second switches.

In the breaker of the second embodiment, the first and second switches are successively tripped as follows. If a fault current occurs in a line, an electron repelling force greater than a contact pressure applied by the movable arm 50 in the interface between contact points of the first switch is generated so that the movable arm 50 is lifted up as shown in FIG. 4*b* to trip the first switch, and also the elastic deformation of the torsion spring 64 acting as a successive trip means is dissolved to release the elastically biased state of the second switch. During a short time that the elastically biased state of the second switch is released, the first switch keeps its tripped state and the second switch keeps its closed state. At an instant that the first switch is tripped, the fault current is directed from the first path I to the second path II, and then limited by the PTC current-limiting device 44. In parallel to the above operation, the movable arm pivoting means detects the fault current of the second path II and rotates the movable arm 50 so as to trip the second switch within a predetermined time as shown in FIG. 4*c*.

Figure 5A:
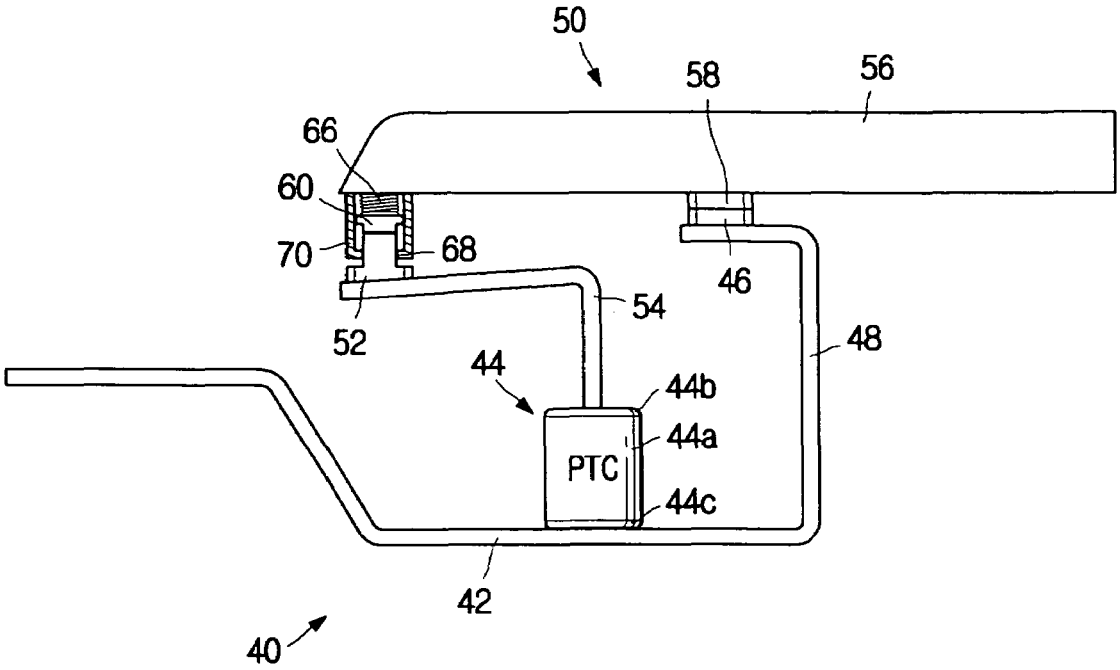
FIGS. 5*a* to 5*c* are side views respectively showing a breaker-closed state, a first switch tripped state, and a first/second switch tripped state according to a third embodiment of the present invention.
Figure 5B:
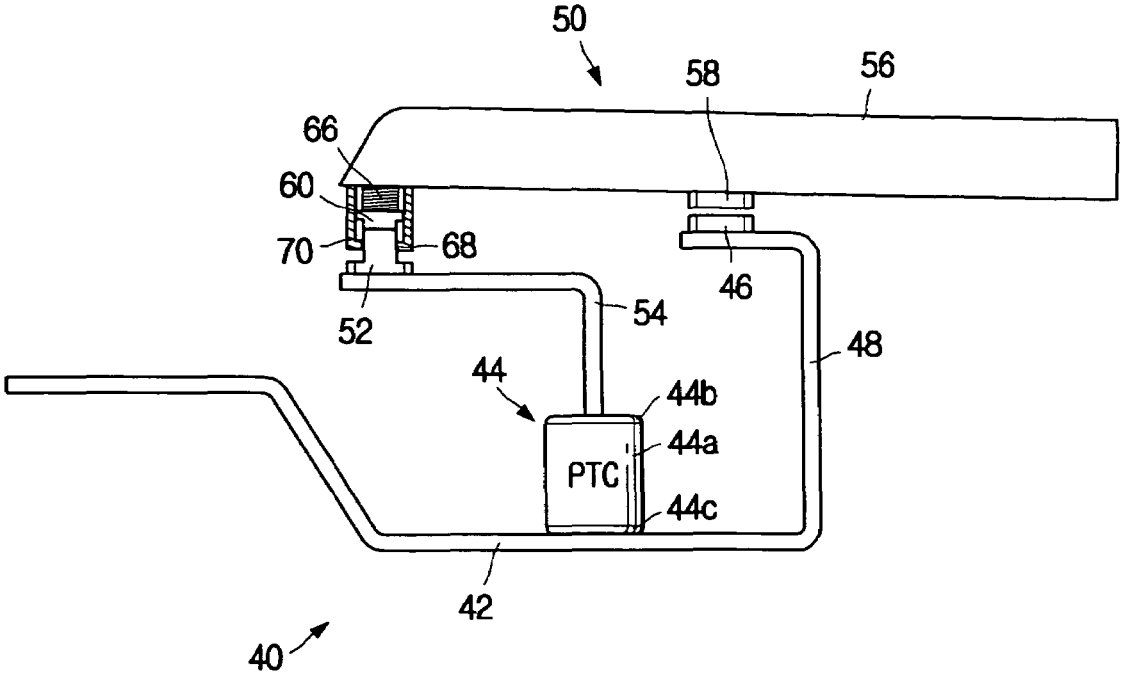
Figure 5C:
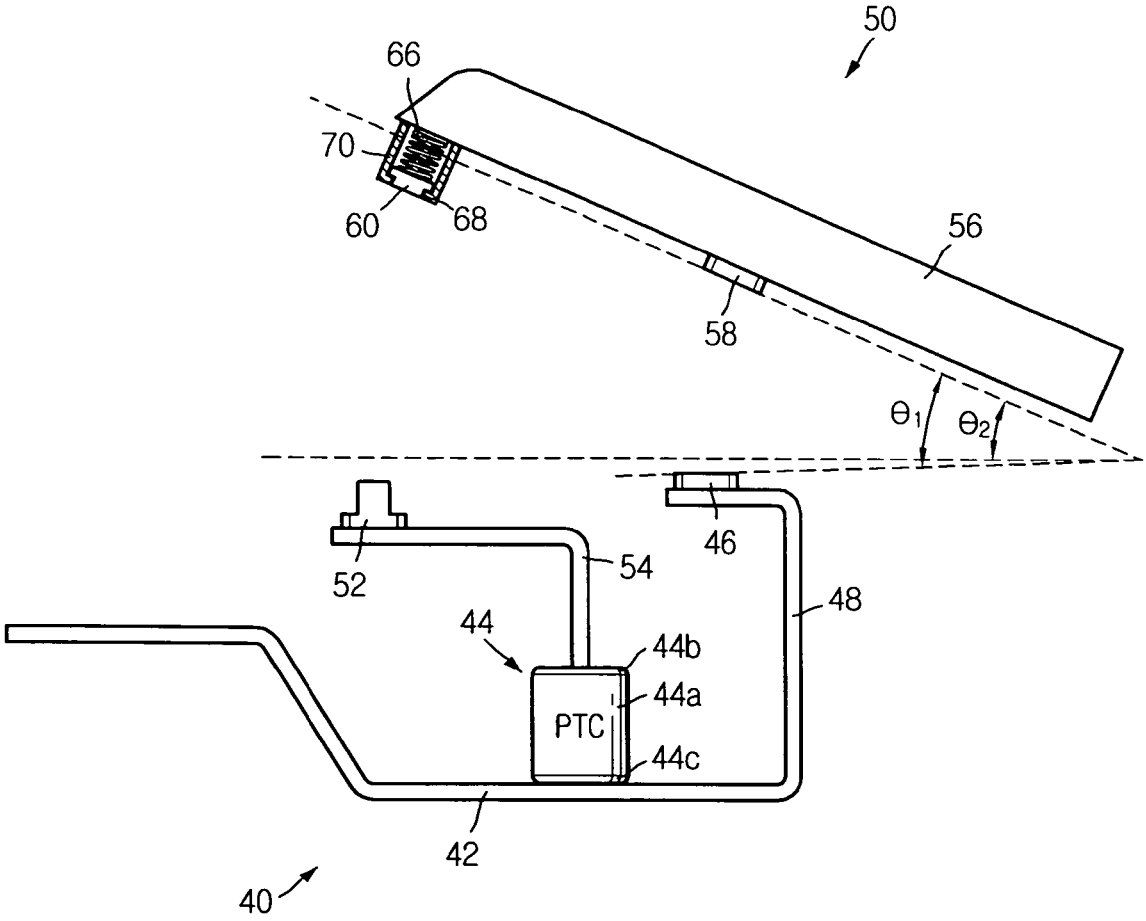

FIGS. 5*a* to 5*c* respectively show a breaker-closed state, a first switch tripped state, and a first/second switch tripped state of a breaker according to a third embodiment of the present invention.

According to the third embodiment of the present invention, a guide housing 70 having a compression spring 66 mounted therein and an opening 68 formed at its lower end is provided below the movable arm 50 as shown in FIGS. 5*a* to 5*c*. In addition, the second movable contact point 60 is received in the guide housing 70 so that its one side faces the compression spring 66 and the other side is exposed outward to face the second fixed contact point 52. In addition, the second fixed contact point 52 has a shape corresponding to the opening 68 so that it may be inserted through the opening 68 prepared in the lower portion of the guide housing 70. Other configurations of the third embodiment are substantially identical to those of the first embodiment.

Like the first embodiment, an angle $\theta_1$ between the first fixed and movable contact points 46 and 58 is relatively greater than an angle $\theta_2$ between the second fixed and movable contact point 52 and 60 in the breaker of the third embodiment, as shown in FIG. 5*c*. Thus, if the movable arm 50 is rotated to close the breaker as shown in FIG. 5*a*, the second fixed contact point 52 is inserted through the opening 68 of the guide housing 70, and then presses the second movable contact point 60 until the first fixed contact point 46 and the first movable contact point 58 come to an electric contact. Then, the compression spring 66 retreats toward the movable arm 50 with being contracted. As a result, if the first fixed contact point 46 and the first movable contact point 58 are electrically contacted completely so that the breaker is completely closed, a contact pressure is generated in the interface between the second fixed contact point 52 and the second movable contact point 60, so the second switch comes to an elastically biased state proportional to the difference of angles '$\theta_1-\theta_2$'. Thus, in the third embodiment, the compression spring 66 acts as a successive trip means that causes successive trips of the first and second switches.

In the breaker of the third embodiment, the first and second switches are successively tripped as follows. If a fault current occurs in a line, an electron repelling force greater than a contact pressure applied by the movable arm 50 in the interface between contact points of the first switch is generated so that the movable arm 50 is lifted up as shown in FIG. 5*b* to trip the first switch, and also the elastic deformation of the compression spring 66 acting as a successive trip means is dissolved to release the elastically biased state of the second switch. During a short time that the elastically biased state of the second switch is released, the first switch keeps its tripped state and the second switch keeps its closed state. At an instant that the first switch is tripped, the fault current is directed from the first path I to the second path II, and then limited by the PTC current-limiting device 44. In parallel to the above operation, the movable arm pivoting means detects the fault current of the second path II and rotates the movable arm 50 so as to trip the second switch within a predetermined time as shown in FIG. 5*c*.

Meanwhile, though not shown in the figures, it is also possible that the second fixed contact point 52 is received in a guide housing (not shown) attached to the second fixed arm conductor 54 together with a compression spring, and the second movable contact point 60 that is made to have a shape corresponding to an opening so as to be inserted into the opening provided in the lower portion of the guide housing is attached to a lower side of the movable arm 50, as a modification of the third embodiment. In this case, in the breaker closing procedure, the second movable contact point 60 presses the second fixed contact point 52 oppositely to the third embodiment so that the compression spring in the guide housing retreats toward the second fixed arm conductor 54. Of course, the successive trip mechanism of the first and second switches are substantially identical to that of the third embodiment.

Figure 6A:
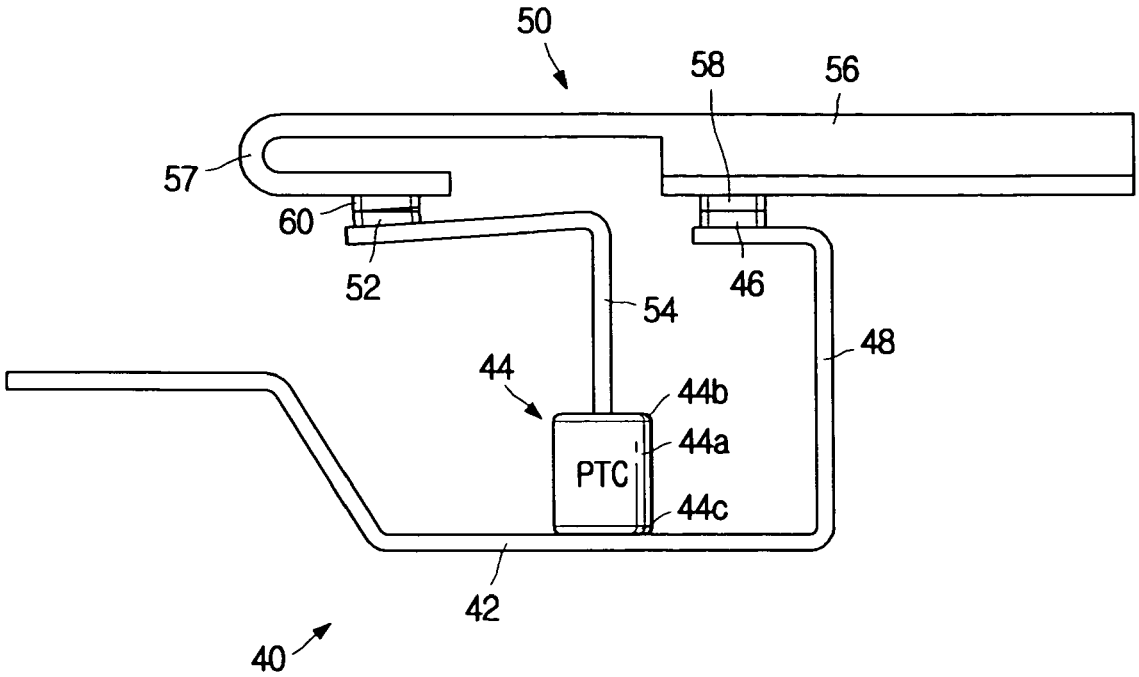
FIGS. 6*a* to 6*c* are side views respectively showing a breaker-closed state, a first switch tripped state, and a first/second switch tripped state according to a fourth embodiment of the present invention.
Figure 6B:
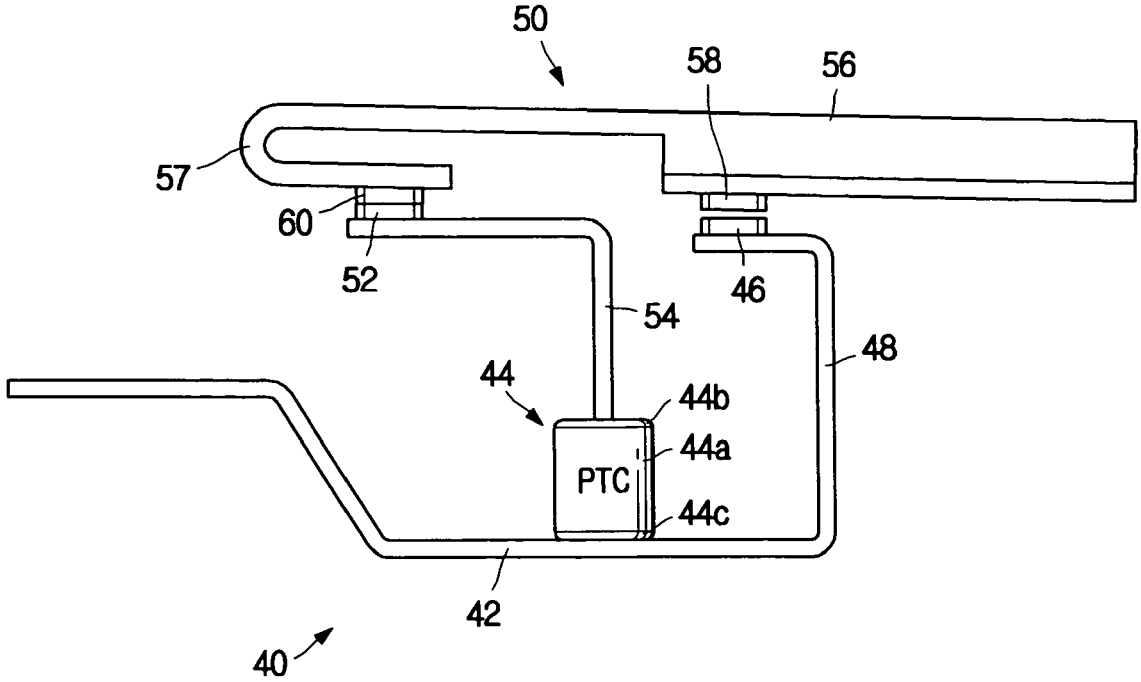
Figure 6C:
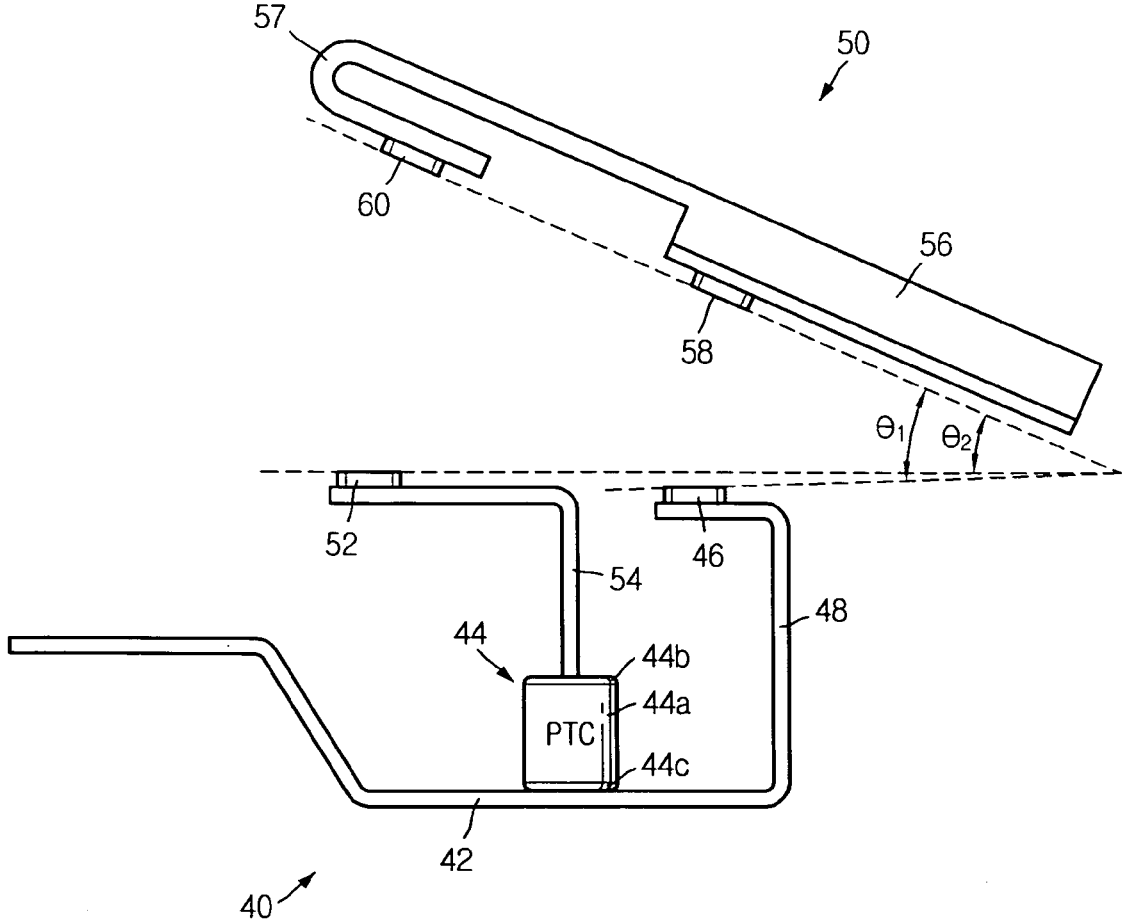

FIGS. 6*a* to 6*c* respectively show a breaker-closed state, a first switch tripped state, and a first/second switch tripped state of a breaker according to a fourth embodiment of the present invention.

According to the fourth embodiment of the present invention, a c-shaped bent 57 having a geometric structure capable of allowing elastic deformation is prepared to one side of the movable arm member 56 as shown in FIGS. 6*a* to 6*c*. In addition, the second movable contact point 60 is attached to a lower side of the bent 57. Other configurations of the fourth embodiment are substantially identical to those of the first embodiment.

Like the first embodiment, an angle $\theta_1$ between the first fixed and movable contact points 46 and 58 is relatively greater than an angle $\theta_2$ between the second fixed and movable contact point 52 and 60 even in the breaker of the fourth embodiment, as shown in FIG. 6*c*. Thus, if the movable arm 50 is rotated to close the breaker as shown in FIG. 6*a*, the second fixed contact point 52 and the second movable contact point 60 are firstly contacted, and then the bent 57 of the movable arm 50 is elastically deformed until the first fixed contact point 46 and the first movable contact point 58 are secondarily contacted. Here, the degree of elastic deformation is proportional to the difference of angles '$\theta_1-\theta_2$'. As a result, if the first fixed contact point 46 and the first movable contact point 58 are completely electrically contacted so that the breaker is completely closed, a contact pressure is generated in the interface between the second fixed contact point 52 and the second movable contact point 60, so the second switch comes to an elastically biased state. Thus, in the fourth embodiment, the geometric structure of the bent 57 of the movable arm 50 acts as a successive trip means that causes successive trips of the first and second switches.

In the breaker of the fourth embodiment, the first and second switches are successively tripped as follows. If a fault current occurs in a line, an electron repelling force greater than a contact pressure applied by the movable arm 50 in the interface between contact points of the first switch is generated so that the movable arm 50 is lifted up as shown in FIG. 6*b* to trip the first switch, and also the elastic deformation of the bent 57 of the movable arm 50 is dissolved to release the elastically biased state of the second switch. During a short time that the elastically biased state of the second switch is released, the first switch keeps its tripped state and the second switch keeps its closed state. At an instant that the first switch is tripped, the fault current is directed from the first path I to the second path II, and then limited by the PTC current-limiting device 44. In parallel to the above operation, the movable arm pivoting means detects the fault current of the second path II and rotates the movable arm 50 so as to trip the second switch within a predetermined time as shown in FIG. 6*c*.

Meanwhile, in the third and fourth embodiments as mentioned above, it should be understood that the second fixed arm conductor 54 may also be deformed to some extent depending on the procedure that the second switch comes to an elastically biased state.

Figure 7A:
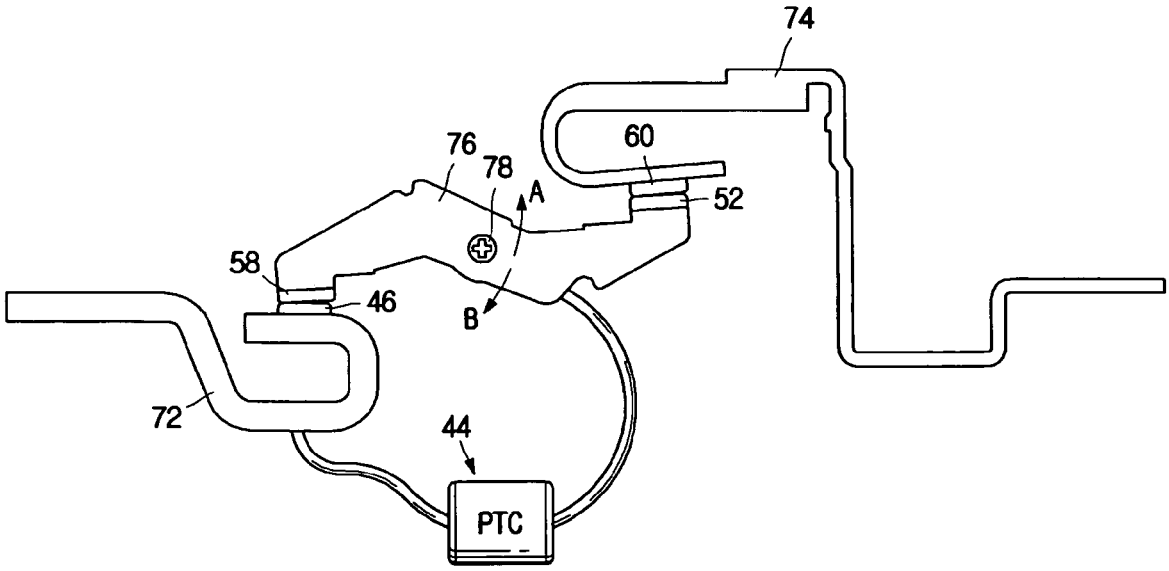
FIGS. 7*a* to 7*c* are side views respectively showing a breaker-closed state, a first switch tripped state, and a first/second switch tripped state according to a fifth embodiment of the present invention.
Figure 7B:
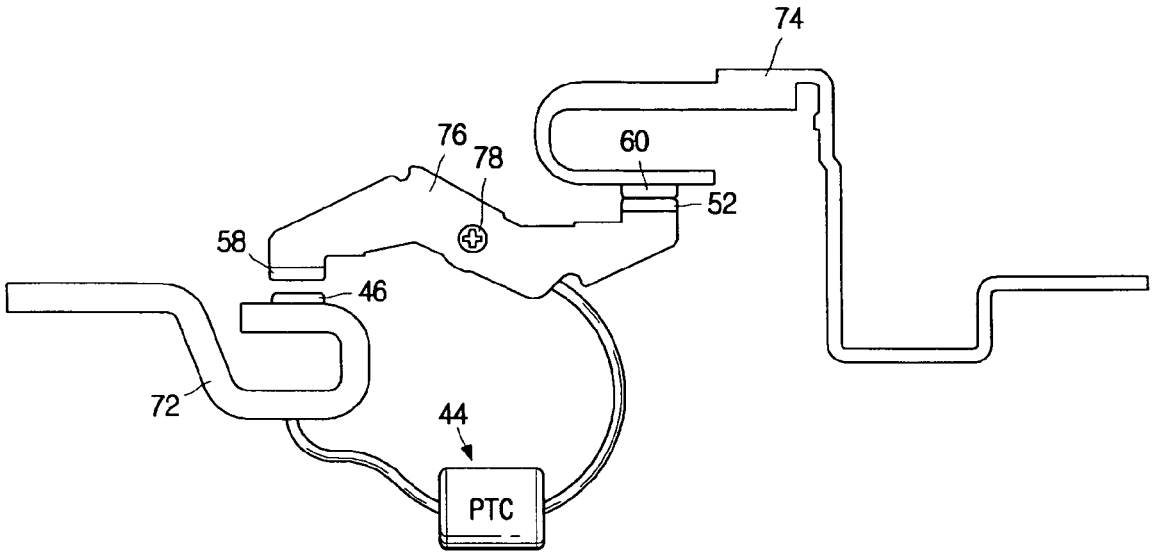
Figure 7C:
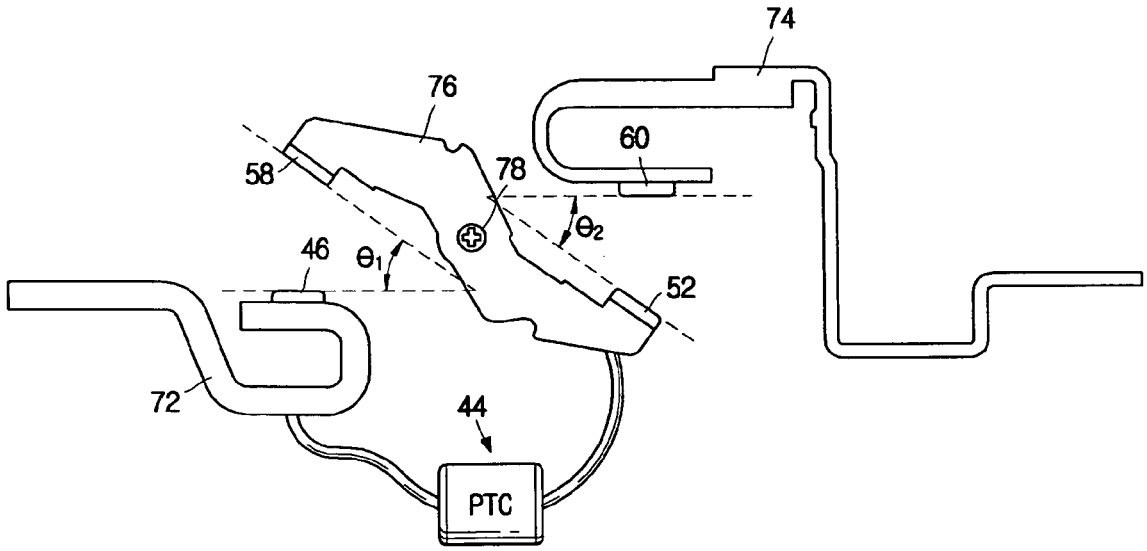

FIGS. 7*a* to 7*c* respectively show a breaker-closed state, a first switch tripped state, and a first/second switch tripped state of a breaker according to a fifth embodiment of the present invention.

According to the fifth embodiment of the present invention, a first fixed arm 72 and a second fixed arm 74 are arranged oppositely on the basis of a movable arm 76, as shown in FIGS. 7*a* to 7*c*. The first fixed arm 72 and the second fixed arm 74 have a geometric structure that allows elastic deformation. Preferably, the geometric structure has a ⊂ shape or a ⊃ shape as shown in FIGS. 7*a* to 7*c*. However, the present invention is not limited thereto. The first fixed contact point 46 and the second fixed contact point 60 are respectively attached to the first fixed arm 72 and the second fixed arm 74.

The movable arm 76 is rotated in an closing direction A or in a tripping direction B on the center of a rotary axis 78 by means of a movable arm pivoting means, not shown. The movable arm pivoting means applies a contact pressure by a wipe spring to the first and second switches when the breaker is in a closed state. The first movable contact point 58 and the second movable contact point 52 are opposite on the basis of the rotary axis 78 of the movable arm 76 and are attached to positions facing the first fixed contact point 46 and the second fixed contact point 60 respectively. The PTC current-limiting device 44 is connected to the first switch composed of the first fixed contact point 46 and the first movable contact point 58 in parallel and also connected to the second switch composed of the second fixed contact point 52 and the second movable contact point 60 in series.

In case of the breaker of the fifth embodiment, as shown in FIG. 7*c*, an angle $\theta_1$ between the first fixed and movable contact points 46 and 58 is relatively greater than an angle $\theta_2$ between the second movable and fixed contact point 52 and 60. Thus, if the movable arm 76 is rotated in the closing direction A to close the first and second switches, the second fixed arm 74 is elastically deformed as shown in FIG. 7*a*. Here, the degree of elastic deformation is proportional to the difference of angles '$\theta_1-\theta_2$'. If the breaker is completely closed, a contact pressure is generated in the interface between the second fixed contact point 60 and the second movable contact point 52, so the second switch comes to an elastically biased state. Thus, in the fifth embodiment, the electrically deformable geometric structure of the second fixed arm 74 acts as a successive trip means that causes successive trips of the first and second switches.

In the breaker of the fifth embodiment, the first and second switches are successively tripped as follows. If a fault current occurs in a line, an electron repelling force greater than a contact pressure applied by the movable arm 76 in the interface between contact points of the first switch is generated so that the movable arm 76 is lifted up as shown in FIG. 7*b* to trip the first switch, and also the elastic deformation of the second fixed arm 74 is dissolved to release the elastically biased state of the second switch. During a short time that the elastically biased state of the second switch is released, the first switch keeps its tripped state and the second switch keeps its closed state. At an instant that the first switch is tripped, the fault current is directed toward the PTC current-limiting device 44. In parallel to the above operation, the movable arm pivoting means detects the fault current and rotates the movable arm 76 in the tripping direction B so as to trip the second switch within a predetermined time as shown in FIG. 7*c*.

Meanwhile, though not shown in the figures, the second fixed arm 74 may have a structure that may be elastically deformed by a torsion spring as shown in FIG. 4*a*, as a modification of the fifth embodiment. As another alternative, it is also possible that the second movable contact point 60 is mounted in a guide housing together with a compression spring as shown in FIG. 5*a*, and the compression spring is compressed by the second fixed contact point 52 having a shape corresponding to an opening of the guide housing while the breaker is closed so that the second switch comes to an elastically biased state.

The present invention has been described in detail based on the limited embodiments and drawings. However, it should be understood that the detailed description and specific examples, while indicating preferred embodiments of the invention, are given by way of illustration only, since various changes and modifications within the spirit and scope of the invention will become apparent to those skilled in the art from this detailed description.

APPLICABILITY TO THE INDUSTRY

According to the present invention, since the PTC current-limiting device is arranged to be spaced apart from contact points where arc is generated and also most of arc energy is consumed by means of heating of the PTC current-limiting device, it is possible to prevent the PTC current-limiting device from being deteriorated by arc while the breaker is closed or makes a successive trip operation.

In another aspect of the present invention, the second fixed contact point and the second movable contact point do not have a high contact resistance since the contact points are not composed using a PTC current-limiting device. Thus, when a fault current is broken, the fault current is easily turned toward the second switch.

In still another aspect of the present invention, if the first switch is released, an elastically biased state of the second switch caused by the successive trip means is released and at the same time a predetermined gap is generated between the first fixed contact point and the second movable contact point. Thus, the present invention may maximize reliability of the breaker since there is no possibility that the first switch is closed again, differently from the prior art in which the first switch is easily closed again after being released.

What is claimed is:

1. A breaker for providing successive trip mechanism based on a PTC (Positive Temperature Coefficient) current-limiting device, the breaker comprising:

a first switch having a first fixed contact point and a first movable contact point;

a second switch having a second fixed contact point and a second movable contact point and connected to the first switch in parallel;

a PTC current-limiting device connected to the second switch in series and to the first switch in parallel, the PTC current-limiting device allowing a change of current flow direction from the first switch to the second switch when a fault current occurs;

a movable arm to which the first and second movable contact points are installed at a predetermined interval therebetween, the movable arm opening/closing the first and second switches by operating the first and second movable contact points;

a fixed arm including a first fixed arm conductor for guiding current flow toward the first fixed contact point in a normal load current mode, and a second fixed arm conductor for guiding current flow toward the second fixed contact point via the PTC current-limiting device in a fault current mode; and a successive trip means for elastically biasing the second switch by means of an operation of the movable arm in a closing direction when the first and second switches are closed, the successive trip means successively tripping the first and second switches using a time taken for releasing the elastic bias of the second switch when the movable arm is operated in a tripping direction.

2. The breaker according to claim 1, wherein the first and second fixed contact points are provided on the first and second fixed arm conductors extended to the first and second fixed contact points so that an angle between the first fixed and movable contact points is greater than an angle between the second fixed and movable contact points while the first and second switches are in a tripped state, and wherein the successive trip means includes a geometric structure of the second fixed arm conductor that elastically biases the second switch in proportion to a relative difference of both angles when the first and second switches are closed.

3. The breaker according to claim 1, wherein the first and second fixed contact points are provided on the first and second fixed arm conductors extended to the first and second fixed contact points so that an angle between the first fixed and movable contact points is greater than an angle between the second fixed and movable contact points while the first and second switches are in a tripped state, and wherein the successive trip means is a torsion spring that elastically biases the second switch by elastically rotating a part of the second fixed arm conductor provided with the second fixed contact point on the center of a predetermined rotary axis in proportion to a relative difference of both angles when the first and second switches are closed.

4. The breaker according to claim 1, wherein the first and second fixed contact points are provided on the first and second fixed arm conductors extended to the first and second fixed contact points so that an angle between the first fixed and movable contact points is greater than an angle between the second fixed and movable contact points while the first and second switches are in a tripped state, wherein the movable arm is provided with a guide housing including a compression spring mounted therein, wherein the second movable contact point is received in the guide housing so that one side thereof faces the compression spring and the other side is exposed outward to face the second fixed contact point, and wherein the successive trip means is the compression spring that elastically biases the second switch by means of a back movement of the second movable contact point in proportion to a relative difference of both angles when the first and second switches are closed.

5. The breaker according to claim 1, wherein the movable arm has a bent that is elastically deformable, wherein the first and second fixed contact points are provided on the first and second fixed arm conductors extended to the first and second fixed contact points, wherein the second movable contact point is provided to the bent, wherein an angle between the first fixed and movable contact points is greater than an angle between the second fixed and movable contact points when the first and second switches are in a tripped state, and wherein the successive trip means is the bent that elastically biases the second switch by being elastically deformed in proportion to a relative difference of both angles when the first and second switches are closed.

6. The breaker according to claim 5, wherein the bent has a '⊂' shape.

7. The breaker according to claim 1, further comprising a movable arm pivoting means for detecting a fault current over a predetermined level when a fault current occurs, and providing the movable arm with a rotating force for tripping the second switch within a predetermined time, wherein the first switch is operated in a tripping direction by means of an electron repelling force generated between the first fixed contact point and the first movable contact point, and the second switch is operated in a tripping direction by means of an electron repelling force generated between the second fixed contact point and the second movable contact point and the rotating force provided by the movable arm pivoting means.

8. The breaker according to claim 7, wherein the second switch is positioned outer than the first switch on the basis of a rotary axis of the movable arm.

9. The breaker according to claim 1, wherein the first fixed arm conductor provides an electric conduction path so that currents around both first fixed and movable contact points of the first switch flow in opposite directions.

10. The breaker according to claim 1, wherein the second fixed arm conductor provides an electric conduction path so that currents around both second fixed and movable contact points of the second switch flow in opposite directions.

11. The breaker according to claim 1, wherein the PTC current-limiting device includes a mixture of polymer resin and conductive material and has a nonlinear resistance characteristic that a specific resistance at 25° C. is 1 Ωcm or below, and the specific resistance is increased to 10 Ωcm or above when a fault current occurs.

12. A breaker for providing successive trip mechanism based on a PTC current-limiting device, the breaker comprising:

a first switch having a first fixed contact point and a first movable contact point;

a second switch having a second fixed contact point and a second movable contact point and connected to the first switch in series;

a movable arm to which the first and second movable contact points are installed oppositely on the center of a rotary axis at a predetermined interval therebetween, the movable arm opening/closing the first and second switches by angularly moving the first and second movable contact points in opposite directions by means of a rotating mechanism;

first and second fixed arms to which the first and second fixed contact points are installed respectively;

a PTC current-limiting device connected to the first switch in parallel and to the second switch in series, the PTC current-limiting device allowing a change of current flow direction from the first switch to the second switch when a fault current occurs; and a successive trip means for elastically biasing the second switch by means of an operation of the movable arm in a closing direction when the first and second switches are closed, the successive trip means successively tripping the first and second switches using a time taken for releasing the elastic bias of the second switch when the movable arm is pivoted in a tripping direction.

13. The breaker according to claim 12, wherein the second fixed arm has a bent that is elastically deformable, wherein the second movable contact point is provided to the bent, wherein an angle between the first fixed and movable contact points is greater than an angle between the second fixed and movable contact points when the first and second switches are in a tripped state, and wherein the successive trip means is the bent that elastically biases the second switch by being elastically deformed in proportion to a relative difference of both angles when the first and second switches are closed.

14. The breaker according to claim 12, wherein an angle between the first fixed and movable contact points is greater than an angle between the second fixed and movable contact points while the first and second switches are in a tripped state, and wherein the successive trip means is a torsion spring that elastically biases the second switch by elastically rotating a part of the second fixed arm provided with the second fixed contact point on the center of a predetermined rotary axis in proportion to a relative difference of both angles when the first and second switches are closed.

15. The breaker according to claim 12, wherein an angle between the first fixed and movable contact points is greater than an angle between the second fixed and movable contact points while the first and second switches are in a tripped state, wherein a guide housing including a compression spring is provided at a position of the movable arm provided with the second movable contact point, wherein the second movable contact point is received in the guide housing so that one side thereof faces the compression spring and the other side is exposed outward to face the second fixed contact point, and wherein the successive trip means is the compression spring that elastically biases the second switch by means of a back movement of the second movable contact point in proportion to a relative difference of both angles when the first and second switches are closed.

16. The breaker according to claim 12, further comprising a movable arm pivoting means for detecting a fault current over a predetermined level when a fault current occurs, and providing the movable arm with a rotating force for releasing the second switch within a predetermined time, wherein the rotating mechanism includes an electron repelling force generated between the first fixed contact point and the first movable contact point when a fault current occurs, and the rotating force provided by the movable arm pivoting means.

17. The breaker according to claim 12, wherein the first fixed arm provides an electric conduction path so that currents around both first fixed and movable contact points of the first switch flow in opposite directions.

18. The breaker according to claim 12, wherein the second fixed arm provides an electric conduction path so that currents around both second fixed and movable contact points of the second switch flow in opposite directions.

19. The breaker according to claim 12, wherein the PTC current-limiting device includes a mixture of polymer resin and conductive material and has a nonlinear resistance characteristic that a specific resistance at 25° C. is 1 Ωcm or below, and the specific resistance is increased to 10 Ωcm or above when a fault current occurs.

* * * * *